US008602000B2

(12) United States Patent
Yoon et al.

(10) Patent No.: US 8,602,000 B2
(45) Date of Patent: Dec. 10, 2013

(54) ENGINE BRAKE UNIT

(75) Inventors: Seock Joong Yoon, Seoul (KR); Kyung Mo Kim, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 1055 days.

(21) Appl. No.: 12/623,252

(22) Filed: Nov. 20, 2009

(65) Prior Publication Data

US 2011/0023821 A1 Feb. 3, 2011

(30) Foreign Application Priority Data

Jul. 31, 2009 (KR) ..... 10-2009-0070724

(51) Int. Cl.
*F02D 13/04* (2006.01)
*F01M 9/10* (2006.01)

(52) U.S. Cl.
USPC ..... 123/321; 123/90.39

(58) Field of Classification Search
USPC ..... 123/90.39, 320, 321
See application file for complete search history.

(56) References Cited

U.S. PATENT DOCUMENTS 5,477,824 A 12/1995 Reedy
5,564,385 A 10/1996 Hakansson
5,586,532 A 12/1996 Faletti et al.
5,957,097 A 9/1999 Schanz
5,975,251 A 11/1999 McCarthy
6,244,257 B1 6/2001 Hu
6,253,730 B1 7/2001 Gustafson
6,257,201 B1 7/2001 Kajiura et al.
6,314,926 B1 11/2001 Meneely et al.
6,334,429 B1 1/2002 Little, Jr.
6,354,254 B1 3/2002 Usko
6,386,160 B1 5/2002 Meneely et al.
6,394,050 B1 5/2002 McCarthy et al.
6,394,067 B1 5/2002 Usko et al.
6,405,707 B1 6/2002 Feucht
6,422,186 B1 7/2002 Vanderpoel
6,450,144 B2 * 9/2002 Janak et al. ..... 123/321
6,594,996 B2 7/2003 Yang
6,691,674 B2 2/2004 McCarthy et al.
RE39,258 E * 9/2006 Cosma et al. ..... 123/321
7,140,333 B2 11/2006 Persson et al.
7,392,772 B2 7/2008 Janak et al.
7,520,262 B2 4/2009 Jeong et al.
7,673,600 B2 3/2010 Yang
7,984,705 B2 7/2011 Yang (Continued)

FOREIGN PATENT DOCUMENTS

JP 57-105510 A 7/1982
JP 1-177401 A 7/1989

(Continued)

*Primary Examiner* — Stephen K Cronin
*Assistant Examiner* — Arnold Castro
(74) *Attorney, Agent, or Firm* — Morgan, Lewis & Bockius LLP

(57) ABSTRACT

An engine brake unit may include a rocker arm having a first space defined in a valve-pressing portion thereof, wherein the first space communicates with a supply passage, through which engine brake oil is introduced, a stopper fixedly provided above the first space of the rocker arm in a predetermined distance, an actuator located inside the first space and having a pressure piston, wherein the pressure piston is selectively raised by hydraulic pressure of the engine brake oil to butt against the stopper, thereby pressing a portion of the rocker arm downwards.

8 Claims, 6 Drawing Sheets

(56) References Cited

U.S. PATENT DOCUMENTS

| | | | | |
|---|---|---|---|---|
| 8,065,987 | B2 | 11/2011 | Yang | |
| 8,210,144 | B2 | 7/2012 | Langewisch | |
| 8,240,278 | B2 | 8/2012 | Jeon et al. | |
| 2003/0024501 | A1 | 2/2003 | McCarthy et al. | |
| 2005/0274341 | A1 | 12/2005 | Usko et al. | |
| 2006/0081213 | A1 | 4/2006 | Yang et al. | |
| 2007/0144472 | A1 | 6/2007 | Yang | |
| 2007/0175441 | A1 | 8/2007 | Jeong et al. | |
| 2007/0193543 | A1 | 8/2007 | Best | |
| 2008/0087239 | A1* | 4/2008 | Wiley et al. | 123/90.16 |
| 2009/0139486 | A1 | 6/2009 | Wagner | |
| 2010/0037854 | A1 | 2/2010 | Yang | |
| 2010/0307451 | A1 | 12/2010 | Lee et al. | |
| 2010/0319657 | A1 | 12/2010 | Dodi et al. | |
| 2011/0023821 | A1 | 2/2011 | Yoon et al. | |
| 2011/0073068 | A1 | 3/2011 | Yoon et al. | |
| 2011/0114060 | A1 | 5/2011 | Jeon et al. | |
| 2011/0132298 | A1 | 6/2011 | Ruggiero et al. | |
| 2011/0220061 | A1 | 9/2011 | Wiley et al. | |

FOREIGN PATENT DOCUMENTS

| | | | |
|---|---|---|---|
| JP | 5-285558 | A | 11/1993 |
| JP | 6-10640 | A | 1/1994 |
| JP | 9-177635 | A | 7/1997 |
| JP | 2001-263017 | A | 9/2001 |
| JP | 2002-510008 | A | 4/2002 |
| JP | 2005-180195 | A | 7/2005 |
| JP | 2006-161596 | A | 6/2006 |
| JP | 2007-64107 | A | 3/2007 |
| KR | 2003-0062676 | A | 7/2003 |
| KR | 10-2007-0012536 | A | 1/2007 |
| KR | 10-0732445 | B1 | 6/2007 |
| KR | 10-2010-0064783 | A | 6/2010 |
| WO | WO 99/50108 | A1 | 10/1999 |

* cited by examiner (a) (b)

ENGINE BRAKE UNIT

CROSS REFERENCE TO RELATED APPLICATION

The present application claims priority to Korean Patent Application Number 10-2008-0070724 filed on Jul. 31, 2009, the entire contents of which application is incorporated herein for all purposes by this reference.

BACKGROUND OF THE INVENTION

1. Field of the Invention

The present invention relates to an engine brake unit, in particular, to one which is located inside an inner space of a rocker arm to reduce size and weight, so as to increase the flow rate of engine brake oil due to a reduction in the volume of a closed circuit where pressure is created, thereby improving the performance thereof.

2. Description of Related Art

Engine braking generally refers to the act of slowing down a vehicle by down-shifting to a lower transmission gear. In engine braking, however, an excessive amount of load is applied to respective parts of an engine since the transmission is down-shifted. This may cause drawbacks such as reduced engine life.

To solve the foregoing problem, a conventional engine brake unit, which can improve engine braking effect by maintaining an exhaust port of a cylinder so that compression stroke does not occur, was introduced.

The engine brake unit is configured so as to be located inside a separate housing.

FIG. 1A is a perspective view illustrating a conventional engine brake unit, and FIG. 1B is a cross-sectional view of the engine brake unit shown in FIG. 1A.

The conventional engine brake unit includes a piston 20 and an interval adjustment screw 30, which press a valve 60 when the engine brake module is in operation, and a control valve 50 and a check ball 40, which generate hydraulic pressure for lowering the piston 20. The engine brake unit also includes a housing 10 that encloses the control valve 50 and the check ball 40. The housing 10 partially encloses the piston 20 and the interval adjustment screw 30.

However, the engine brake unit located in a separate housing leads to an increase in the number of parts, thereby disadvantageously increasing manufacturing costs and weight. In addition, the interval adjustment screw and the piston located in the same space increase the volume inside the housing where the hydraulic pressure is generated. This, as a result, slows down the response speed of the engine brake, thereby deteriorating the performance of the engine brake.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine brake unit, which achieves a small and light structure by reducing the number of parts so as to be located inside the inner space of a rocker arm and improves performance by reducing a space where hydraulic pressure is created.

In an aspect of the present invention, the engine brake unit may include a rocker arm having a first space defined in a valve-pressing portion thereof, wherein the first space communicates with a supply passage, through which engine brake oil is introduced, a stopper fixedly provided above the first space of the rocker arm in a predetermined distance, an actuator located inside the first space and having a pressure piston, wherein the pressure piston is selectively raised by hydraulic pressure of the engine brake oil to butt against the stopper, thereby pressing a portion of the rocker arm downwards.

The rocker arm may further include a discharge passage connected to the first space, and a control valve located in a second space defined in the rocker arm and selectively opening the discharge passage to discharge the engine brake oil which is introduced into the first space.

The control valve may be closed by the hydraulic pressure supplied to the control valve through a second passage connecting the supply passage with the second space.

The control valve may be slidably located inside the second space, extending across the discharge passage and biased by an elastic member to open the discharging passage.

The actuator may include the pressure piston having a storage therein, a main elastic member elastically biasing the pressure piston towards a first passage connecting the supply passage with the first space, a check ball disposed onto an entrance of the first passage in the storage of the pressure piston, and a sub-elastic member disposed in the storage of the pressure piston and elastically biasing the check ball towards the entrance of the first space to open or close the entrance of the first space according to the hydraulic pressure supplied to the first passage.

A first snap ring may be fixedly fitted into a groove defined in an upper inner circumference of the first space and slidably encloses the pressure piston so that the main elastic member disposed between a lower portion of the pressure piston and the first snap does not escape from the first space.

The control valve may be slidably located inside the second space, extending across the discharge passage and biased to open the discharging passage by an elastic member, wherein the control valve includes, a control piston moving along a longitudinal direction of the second space to open/close the discharge passage, wherein the second space is across the discharge passage and communicates with the outside, the elastic member elastically biasing the control piston to open the discharge passage, a plate having a center hole to communicate with the outside and holding the elastic member in the second space so that the elastic member does not escape from the second space, and a second snap ring fitted into a groove defined in an upper inner circumference of the second space to hold the plate in the second space.

In another aspect of the present invention, the engine brake unit may further include a holder fixing the stopper in a position spaced apart from a top surface of the pressure piston in the predetermined distance, wherein a screw is integrally provided with the stopper and screw-connected with the holder to allow adjustment of the predetermined distance.

According to various aspects of the present invention, the engine brake unit can reduce weight and manufacturing costs by reducing the number of parts. In addition, the engine brake unit located inside the rocker arm reduces the space where hydraulic pressure is created, thereby improving its performance due to high response rate.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1A:
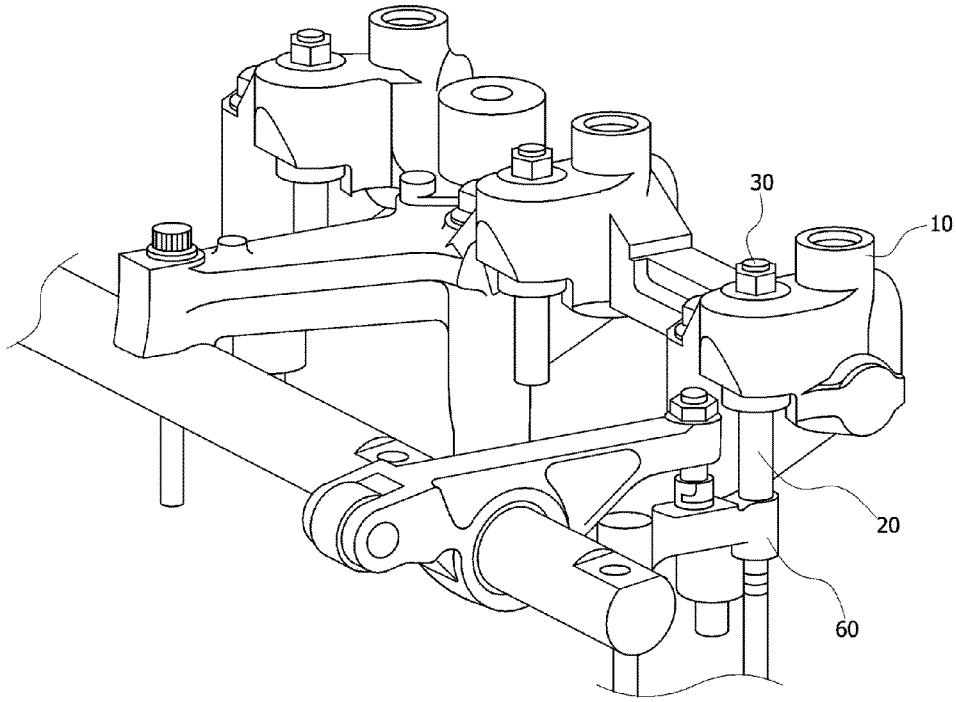
FIG.1a (Prior Art)
FIG. 1A is a perspective view illustrating a conventional engine brake unit.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
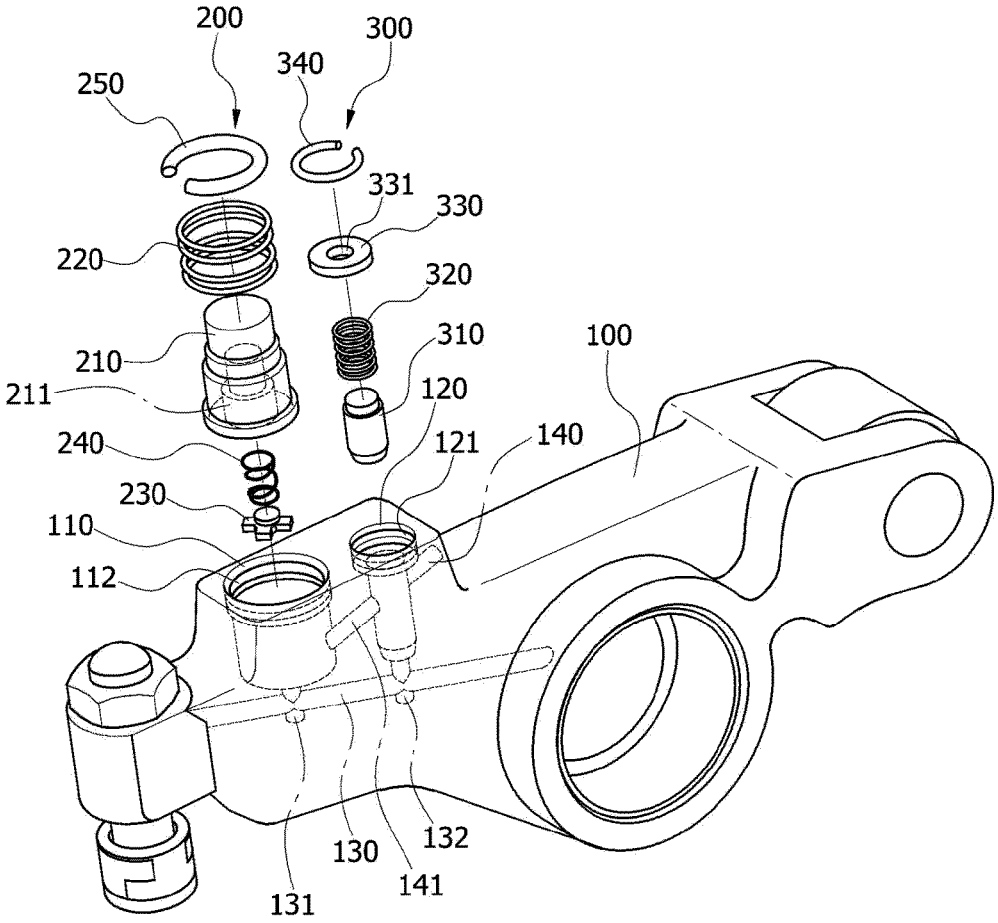
FIG. 2 is an exploded perspective view illustrating an engine brake unit in accordance with an exemplary embodiment of the invention.
Figure 3:
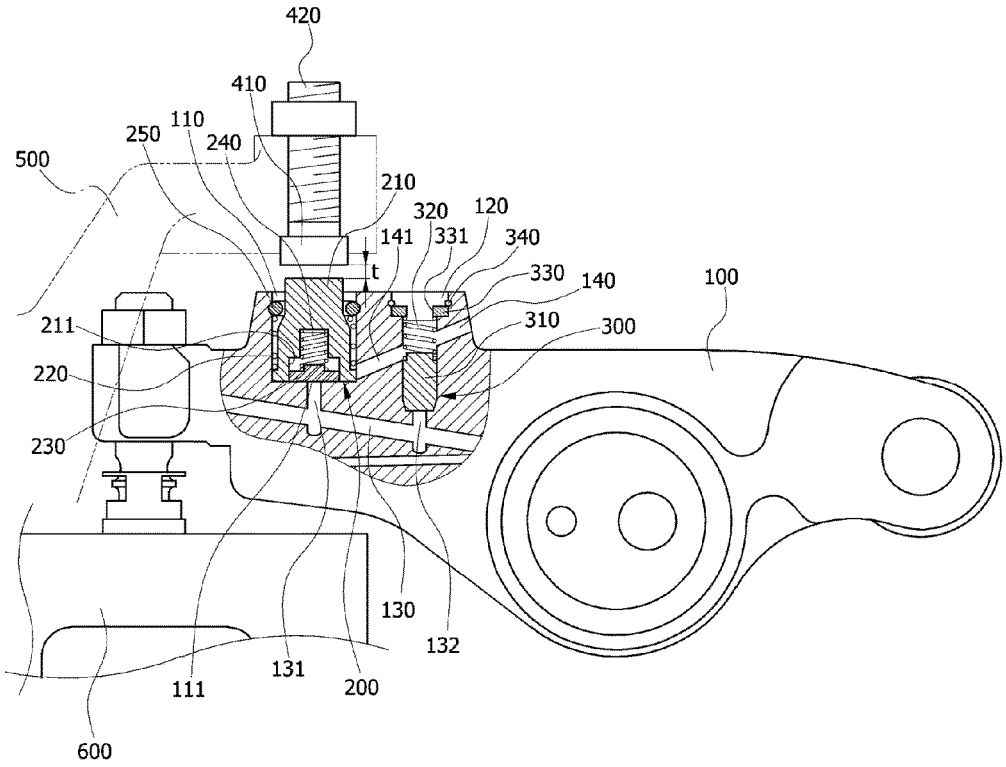
FIG. 3 is a cross-sectional view illustrating the engine brake unit shown in FIG. 2.

FIG. 2 is an exploded perspective view illustrating an engine brake unit in accordance with an exemplary embodiment of the invention, and FIG. 3 is a cross-sectional view illustrating the engine brake unit shown in FIG. 2.

The engine brake module of this embodiment includes a rocker arm 100, a stopper 410, an actuator 200, and a control valve 300. The rocker arm 100 defines therein first and second spaces 110 and 120. The stopper 410 is located above the first space 110 of the rocker arm 100, spaced apart from the top surface of the first rocker arm 100 at a predetermined interval. The actuator 200 is located inside the first space 110, and the control valve 300 is located inside the second space 120.

The rocker arm 100 is angularly driven about a cam shaft by a cam, thereby pressing a valve 600. An external force can be applied to the rocker arm 100 to press the valve 600 so that the valve 600 can maintain an opened position when the engine brake is in operation.

For this, the rocker arm 100 has the first space 110 in which the actuator 200 is located, and the stopper 410 is fixedly located above the first space 110, spaced apart from the first space 110 at the predetermined interval.

When the engine brake is actuated in this position, the hydraulic pressure of engine brake oil raises a pressure piston 210 of the actuator 200 from inside the first space 110 to a position beyond the interval between the stopper 410 and the first space 110. As the rising pressure piston 210 butts against the stopper 410, the rocker arm 100 is relatively moved to press the valve 600. This, as a result, allows the valve 600 to maintain the open position.

When the engine brake is to be stopped, it is required to discharge engine brake oil, stored in the first space 110, in order to close the valve 600. For this, a discharge passage 140 communicating with the outside is provided in the rocker arm 100, and the control valve 300 serves to open/close the discharge passage 140. The control valve 300 is located inside the second space 120, which extends across the discharge passage 140. Like the actuator 200, the control valve 300 is actuated by the hydraulic pressure of engine brake oil to discharge engine brake oil, stored in the first space 110, out of the rocker arm 100.

Since the actuator 200 and the control valve 300 are located inside the rocker arm 100, particularly, inside the first and second spaces 110 and 120, a separate housing is not required. This feature can reduce manufacturing costs and weight, as well as advantageously facilitating the laying-out of the engine brake unit.

A supply passage 130 is formed under the first and second spaces 110 and 120 of the rocker arm 100 in order to supply engine brake oil into the first and second spaces 110 and 120. Engine brake oil, supplied to the supply passage 130, is introduced into the first space 110 along a first passage 131 connecting the supply passage 130 with the first space 110 and into the second space 120 along a second passage 132 connecting the supply passage 130 with the second space 120. When engine brake oil is supplied as above, it generates hydraulic pressure, which in turn can actuate the actuator 200 and the control valve 300.

The actuator 200 of this embodiment includes the pressure piston 210, a main elastic member 220 pressing the pressure piston 210 towards the first passage 131, a check ball 230 opening/closing an entrance 111 of the first space 110, a sub-elastic member 240 pressing the check ball 230 towards the first passage 131, and a snap ring 250 maintaining the main elastic member 220 in position.

The pressure piston 210 is cylindrically shaped to be in contact with the inner circumference of the first space 110. The pressure piston 210 butts against the stopper 410 when it moves along the longitudinal direction of the first space 110. As the pressure piston 210 rises to butt against the stopper 410, a connecting passage 141 communicating with the second space 120 is opened. The connecting passage 141 is a portion of the discharge passage 140, formed between the second space 120 extending across the discharge passage 140 and the first space 110.

The pressure piston 210 is elastically forced towards the first passage 131 of the supply passage 130 by the main elastic member 220. With this configuration, when hydraulic pressure is removed, the pressure piston 210 descends to the original position from the raised position under the restoring force of the main elastic member 220.

The check ball 230 of the actuator 200 serves to open/close the entrance 111 of the first space 110, and the pressure piston 210 has therein a storage 211 primarily storing engine brake oil when the check ball 230 opens the entrance 111 of the first space 110.

Accordingly, the check ball 230 is driven inside the storage 211, along the longitudinal direction of the storage 211, to open/close the entrance 111 of the first space 110. The sub-elastic member 240 located between the ceiling of the storage 211 and the check ball 230 presses the check ball 230 towards the entrance 111 of the first space 110.

The control valve 300 of this embodiment includes a control piston 310 movable along the longitudinal direction of the second space by engine brake oil and an elastic member 320 applying an elastic force to the control piston 310 to open the discharge passage 140.

The control piston 310, cylindrically shaped to be in close contact with the second space 120, is driven along the longitudinal direction of the second space 120 under the hydraulic pressure of engine brake oil, thereby opening/closing the discharge passage 140.

The elastic member 320 is located between a plate 330, which will be described later, and the control piston 310. The elastic member 320 serves to press the control piston 310 towards the second passage 132 of the supply passage 130 so that the control piston 310 opens the discharge passage 140. When the control piston 310 is raised under the hydraulic pressure of engine brake oil, the elastic member 320 is compressed so that the control piston 310 closes the discharge passage 140. When the hydraulic pressure is removed, the compressed elastic member 320 restores the original shape so that the control piston 310 can descend.

The second space 120 includes upper and lower portions, in which the inner diameter of the upper portion is greater than that of the lower portion. The upper portion of the second space 120 is closed by the plate 330 the outer diameter of which is the same as the upper inner diameter of the second space 120. The plate 330 has a center hole 331, through which oil introduced into the second space 120 can be discharged. The elastic member 320 can also be stably supported by the plate 330.

In addition, the first space 110 has a groove 112 in the upper inner circumference thereof, into which the snap ring 250 is fitted, and the second space 120 has a groove 121 in the upper inner circumference thereof, into which the snap ring 340 is fitted. The snap rings 250 and 340 fitted into the grooves 112 and 121 hold the main elastic member 220 and the plate 330 so as not to escape from the first and second spaces 110 and 120, respectively.

The stopper 410 is located above the first space 110 of the rocker arm 100, spaced apart from the top surface of the rocker arm 110 at a predetermined interval, and is fixed by a separate holder 500. An interval t is defined between the underside of the stopper 410 and the top surface of the pressure piston 210 of the actuator 200. The stopper 410 is integrally provided with the screw 420 such that the interval t can be easily adjusted.

Since the screw 420 is screw-connected with the holder 500, the stopper 410 can be fixed in position above the first space 110 while maintaining the interval t from the pressure piston 210.

The operation of the engine brake unit configured as above will be described below with reference to FIGS. 4A through 4C and FIGS. 5A and 5B together with foregoing FIG. 3.

Engine brake oil is not supplied when the engine brake is not in operation. As shown in FIG. 3, the check ball 230 is pressed by the sub-elastic member 240, closing the entrance 111 of the first space 110, the pressure piston 210 is pressed towards the first passage 131 of the supply passage 130 by the main elastic member 220, and the control piston 310 is pressed towards the second passage 132 by the elastic member 320.

In addition, since the stopper 410 is fixed above the first space 110, spaced apart from the top surface of the pressure piston 210, the pressure piston 210 does not come into contact with the stopper 410 when the rocker arm 100 rotates.

Figure 4:
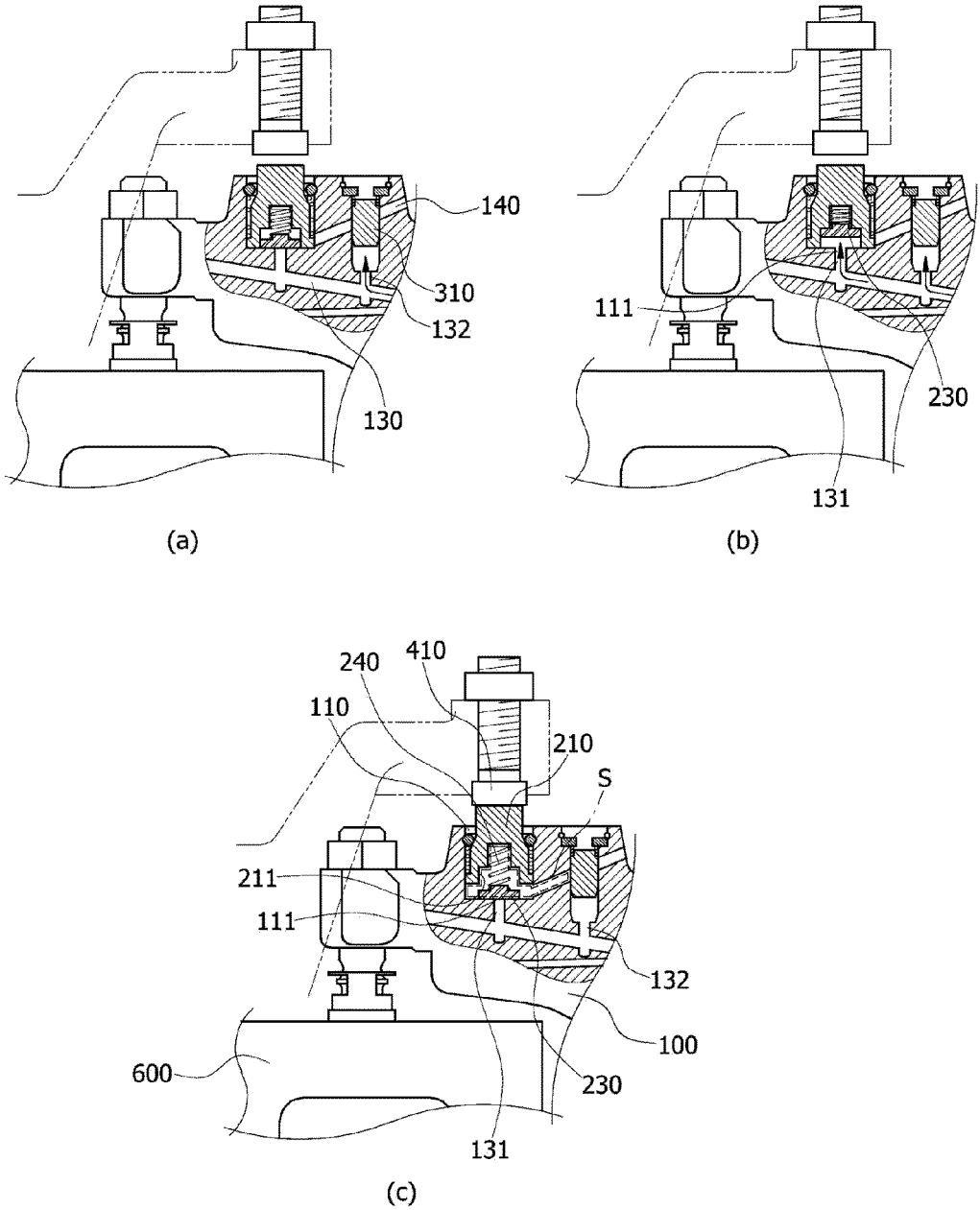
FIGS. 4A through 4C and FIGS. 5A and 5B are cross-sectional views illustrating operation states of the engine brake unit shown in FIG. 2.

When the engine brake is operated from this position, engine brake oil is supplied to the supply passage 130. Engine brake oil is primarily supplied into the second passage 132 of the supply passage 130, so that the control piston 310 is raised to close the discharge passage 140 (FIG. 4A). Engine brake oil is then supplied to the first passage 131 of the supply passage 130, so that the check ball 230 opens the entrance 111 of the first space 110 (FIG. 4B).

As the first space entrance 111 is opened, engine brake oil is introduced into the storage 211 of the pressure piston 210, and the compressed sub-elastic member 240 presses the check ball 230 towards the first space entrance 111 while restoring the original shape. When the check ball 230 closes the first space entrance 111, hydraulic pressure is created in the first space 110, which in turn raises the pressure piston 210 to butt against the stopper 410 (FIG. 4C).

Since the check ball 230 closes the first space entrance 111 after engine brake oil is introduced into the first space 110, the hydraulic pressure inside the first space 110 can be constantly maintained.

Figure 1B:
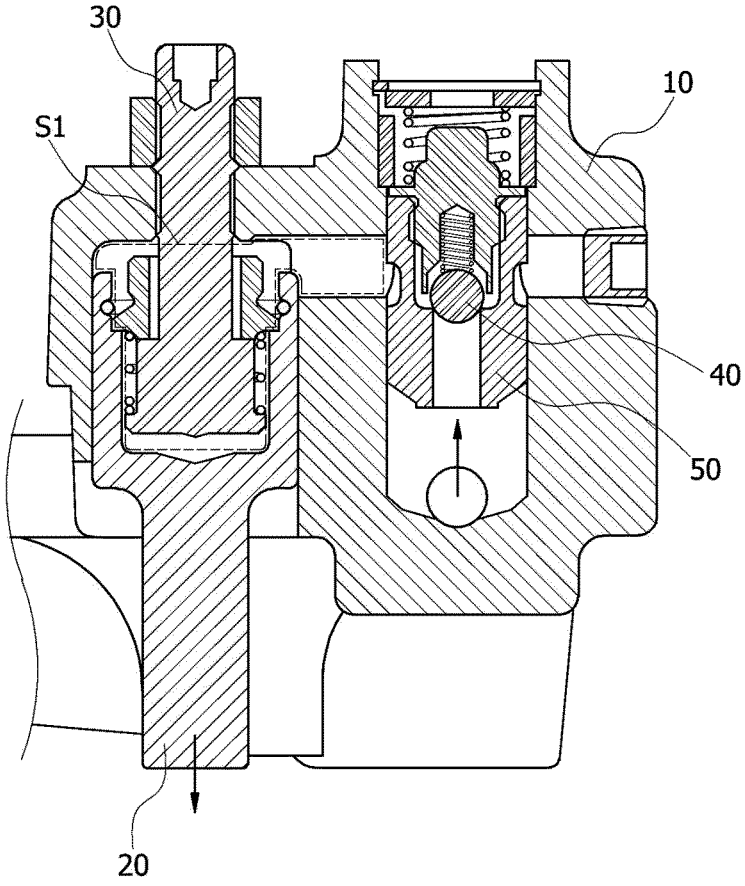
FIG.1b (Prior Art)
FIG. 1B is a cross-sectional view illustrating the engine brake unit shown in FIG. 1A.

Here, engine brake oil is supplied substantially at the same time to both the first and second passages 131 and 132 of the supply passage 130. Since a storage volume S of the first space 110, in which engine brake oil is stored, is smaller than the volume S1 shown in FIG. 1B, the hydraulic pressure is created at a higher rate. This, as a result, can improve the performance of the engine brake unit.

The pressure piston 210 is raised to a position beyond the interval t between the pressure piston 210 and the stopper 410, and the rocker arm 100 has a displacement $\alpha$ corresponding to a value obtained by subtracting the interval t from the raised height of the pressure piston 210. The interval t can preferably be adjusted to a proper value so that the valve 600 is not brought into contact with a piston inside a cylinder (not shown) by the displacement of the rocker arm 100.

As set forth above, the valve 600 can maintain the opened position due to the displacement of the rocker arm 100. This, as a result, can slow down a vehicle by disabling compression stroke.

When the engine brake is stopped in this position, the control piston 310 descends since engine brake oil is not supplied. Due to the descent of the control piston 310, engine brake oil inside the first space 110 is introduced into the second space 120, more particularly, into an area above the control piston 310, and is then discharged out of the rocker arm 100 through the discharge passage 140 and the hole 331 of the plate 330 (FIG. 5A).

Figure 5:
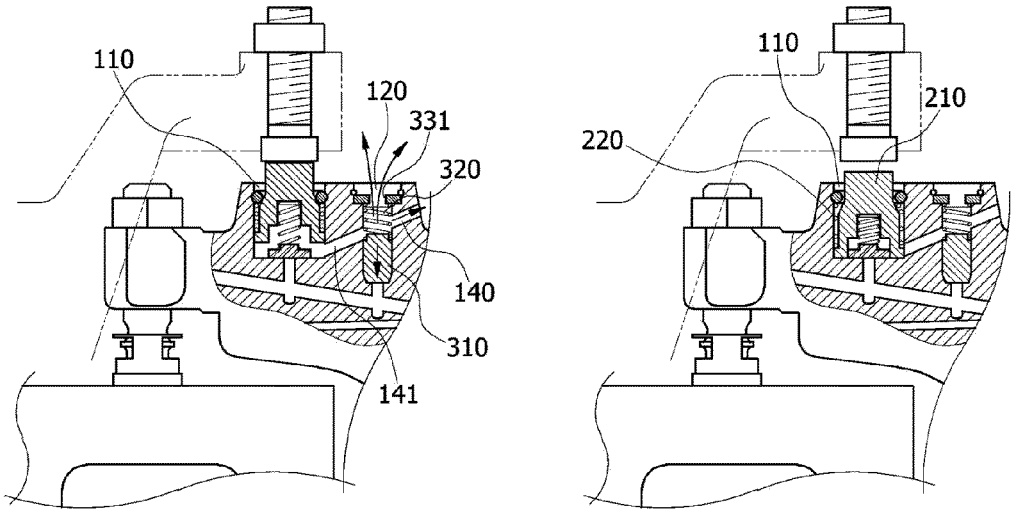

When engine brake oil is completely discharged from the first space 110, the pressure piston 210 restores the original position under the restoring force of the main elastic member 220 (FIG. 5B).

For convenience in explanation and accurate definition in the appended claims, the terms "upper" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine brake unit, comprising:

a rocker arm having a first space defined in a valve-pressing portion thereof, wherein the first space communicates with a supply passage, through which engine brake oil is introduced;

a stopper fixedly provided above the first space of the rocker arm in a predetermined distance;

an actuator located inside the first space and having a pressure piston, wherein the pressure piston is selectively raised by hydraulic pressure of the engine brake oil to butt against the stopper, thereby pressing a portion of the rocker arm downwards;

wherein the rocker arm further includes:

a discharge passage connected to the first space; and a control valve located in a second space defined in the rocker arm and selectively opening the discharge passage to discharge the engine brake oil which is introduced into the first space;

wherein the actuator comprises:

the pressure piston having a storage therein;

a main elastic member elastically biasing the pressure piston towards a first passage connecting the supply passage with the first space;

a check ball disposed onto an entrance of the first passage in the storage of the pressure piston; and a sub-elastic member disposed in the storage of the pressure piston and elastically biasing the check ball towards the entrance of the first space to open or close the entrance of the first space according to the hydraulic pressure supplied to the first passage.

2. The engine brake unit in accordance with claim 1, wherein the control valve is closed by the hydraulic pressure supplied to the control valve through a second passage connecting the supply passage with the second space.

3. The engine brake unit in accordance with claim 1, wherein the control valve is slidably located inside the second space, extending across the discharge passage and biased by an elastic member to open the discharging passage.

4. The engine brake unit in accordance with claim 1, wherein a first snap ring is fixedly fitted into a groove defined in an upper inner circumference of the first space and slidably encloses the pressure piston so that the main elastic member disposed between a lower portion of the pressure piston and the first snap does not escape from the first space.

5. The engine brake unit in accordance with claim 1, wherein the control valve is slidably located inside the second space, extending across the discharge passage and biased to open the discharging passage by an elastic member.

6. The engine brake unit in accordance with claim 5, wherein the control valve comprises:

a control piston moving along a longitudinal direction of the second space to open/close the discharge passage, wherein the second space is across the discharge passage and communicates with the outside;

the elastic member elastically biasing the control piston to open the discharge passage;

a plate having a center hole to communicate with the outside and holding the elastic member in the second space so that the elastic member does not escape from the second space; and a second snap ring fitted into a groove defined in an upper inner circumference of the second space to hold the plate in the second space.

7. The engine brake unit in accordance with claim 1, further comprising:

a holder fixing the stopper in a position spaced apart from a top surface of the pressure piston in the predetermined distance.

8. The engine brake unit in accordance with claim 1, wherein a screw is integrally provided with the stopper and screw-connected with the holder to allow adjustment of the predetermined distance.

* * * * *